US007399929B2

(12) United States Patent
Ueno et al.

(10) Patent No.: US 7,399,929 B2
(45) Date of Patent: Jul. 15, 2008

(54) FLEXIBLE FLAT CABLE

(75) Inventors: Yoshifumi Ueno, Tochigi (JP); Hiroshi Takamatsu, Tochigi (JP); Noriaki Kudo, Tochigi (JP)

(73) Assignee: Sony Chemical & Information Device Corporation, Tokyo (JP)

( * ) Notice: Subject to any disclaimer, the term of this patent is extended or adjusted under 35 U.S.C. 154(b) by 60 days.

(21) Appl. No.: 11/569,490

(22) PCT Filed: Apr. 21, 2005

(86) PCT No.: PCT/JP2005/007623

§ 371 (c)(1),
(2), (4) Date: Nov. 21, 2006

(87) PCT Pub. No.: WO2005/114676

PCT Pub. Date: Dec. 1, 2005

(65) Prior Publication Data

US 2007/0193770 A1 Aug. 23, 2007

(30) Foreign Application Priority Data

May 24, 2004 (JP) ..... 2004-153519

(51) Int. Cl.
*H01B 7/08* (2006.01)

(52) U.S. Cl. ..... 174/117 FF; 174/117 A

(58) Field of Classification Search ..... 174/117 F, 174/117 FF, 117 A

See application file for complete search history.

(56) References Cited

U.S. PATENT DOCUMENTS

| | | | | |
|---|---|---|---|---|
| 6,740,816 | B2 * | 5/2004 | Treutlein et al. | 174/117 F |
| 7,091,422 | B1 * | 8/2006 | Stotz | 174/117 F |
| 2003/0178221 | A1 * | 9/2003 | Chiu et al. | 174/117 F |

FOREIGN PATENT DOCUMENTS

| | | |
|---|---|---|
| JP | 2003-031033 | 1/2003 |

* cited by examiner

*Primary Examiner*—Chau N Nguyen
(74) *Attorney, Agent, or Firm*—Bell, Boyd & Lloyd LLP

(57) ABSTRACT

A flexible flat cable is provided. The FFC comprises multiple conductors with widths of 0.3(±0.03)mm arranged in a parallel manner with a pitch of 0.5 (±0.05)mm, the first insular material and the second insular material sandwiching these conductors from both sides, shield material, and the reinforcement board. The first insular material is porous PET possessing a 34 μm thick porous layer and the shield material is a polymer-based shield material possessing a shield layer made of a polymer-based conductive layer equal to or less than 20 μm thick that is a prescribed resin formed including air with uniformly dispersed conductive particles. Due to this, the FFC maintains the shield effect without damaging the electrical characteristics and also, along with being compatible with existing connecters, can combine with the electrical traits by existing processes and furthermore is capable of being established with any number of wires, any length of cable, and any alignment of wiring.

9 Claims, 9 Drawing Sheets

FLEXIBLE FLAT CABLE

CROSS REFERENCE TO RELATED APPLICATIONS

The present application claims priority to Japanese Patent Document No. P2004-153519 filed on May 24, 2004, the disclosure of which is herein incorporated by reference.

FIELD OF THE INVENTION

The present invention relates to a flexible flat cable used as a connecting cable in a variety of parts internally disposed within a variety of electrical products.

BACKGROUND ART

Conventionally, a so-called flexible flat cable (Flexible Flat Cable; hereinafter referred to as FFC) is often used as a connecting cable internally disposed within various electrical products, especially printers and scanners. Due to its superior flexibility, the FFC can be used in moving parts and furthermore, when compared to the flexible print circuit (Flexible Print Circuit; FPC), has a lower manufacturing cost which leads to lower cost per unit, making it applicable in a wide range of fields.

It is to be noted that conventionally, the FFC did not require any type of characteristic impedance or electrical characteristics. Due to this the FFC, as shown in FIG. 1, has a core conductor 101 affixed from both sides by the base film 103, made of polyethylene terephthalate and the like attached to the fixed adhesive layer 102, and when laminated is able to fulfill the necessary specification requirements solely through the adhesion of the base film 103 on both sides.

To the contrary, in recent years the development of electrical products that realized increased high definition quality of graphics such as notebook style personal computers and digital scanners has been accompanied by a demand for an increase in the speed of signal transmissions. Furthermore, even in the case of other electrical products, as progressing towards digitalization, those products raise imperative technological problems in increased speed of signal transmissions.

Generally, when a signal transmission cable does a high speed signal transmission, the cable lowers the resistance to noise, so that a high speed signal transmission comes to be demanded. However, with this cable, the acceleration of the signal transmission speed may raise the problem of unnecessary radiation (Electromagnetic Interference; EMI). In other words, by this method of signal transmission where the signal wave frequency is high, EMI noise (electromagnetic waves) becomes easily leaked causing noise to enter into the neighboring cables, which is known to cause such adverse effects as malfunctions and transmission loss of signal.

To the contrary, from the idea that if the source of noise generation can be sealed in a metallic film then the noise will not leak, a countermeasure is commonly undertaken whereby the outer circumference of the FFC product, as shown in FIG. 2(*a*) and FIG. 2(*b*), is formed with a shield layer 105 wherein multiple conductors 106 are established linearly and any given conductor is connected to the appropriate shield layer 105 which in turn is connected to a ground line (G). However, this shield does not regulate electrical characteristics.

In other words, with this signal transmission cable, the formation of the shield layer as an EMI countermeasure does decrease the problems caused by noise but form the viewpoint of attempting to accelerate the signal transmission speed it is impossible to ignore the effect of transmission loss caused by the inability of impedance matching within the cable. With this cable, reflection may occur in the cable due to the inability of impedance matching, leading to the reflected signal being emitted as noise outside of the cable.

The shield is thought to be one of the causes of this type of reflection. In other words, with this cables it is necessary to use metallic plates or metallic films as a shielding plate in order to prevent noise leakage to the outside. This method is effective as an EMI countermeasure but, from the viewpoint of electrical characteristics, creates inconveniences such as a large increase in electrostatic capacity and a lowering of characteristic impedance due to the existence of a metallic body in proximity to the signal transmission conductor. As a method for lowering this type of electrostatic capacity, physical measures such as decreasing the cross-sectional pile of the conductors, expanding the pitch between the conductors, and expanding the distance between the conductors and metallic bodies are effective but have a large effect on the specifications of the product and cannot be easily changed. Further, due to mobility requirements, the FFC has strict limitations placed on thickness and also when considering the stress placed on the FFC when flexing, a slimmer form is desirable. Of course with an FFC it is conceivable to remove the shield that causes the decrease of impedance, but this would be rash to simply remove the shield due to the effect of the noise.

In the manner described above, with this cable, it especially becomes extremely difficult to make an FFC appropriate for high speed transmission due to the shield equipped as a noise countermeasure, because the shield layer may impair the electrical property of the cable.

Furthermore, with the FFC, there is tested characteristic impedance regulation technology, such as that described in patent document 1.

Patent document 1: Japanese Patent Application Laid-Open No. 2003-31033

Specifically, in this patent document 1, a flexible flat cable equipped with a metallic layer having an attached conductivity adhesive layer wherein a row of multiple conductors arranged in a parallel manner and a foam insulator with an adhesive layer that is laminated after sandwiching this row of conductors from both sides further sandwich a foam insulator having an adhesive agent on both sides is disclosed. In this manner, this flexible flat cable, due to the lamination of the foam insulator having sandwiched the row of conductors at both ends, the dielectric constant of the foam insulator is combined with the dielectric constant of the air allowing the combined dielectric constant to be lower than the dielectric constant of the insulator that is not yet foaming, making it possible to regulate the electrostatic capacity which is the characteristic impedance factor and make the characteristic impedance factor 50 Ohms. Furthermore, with this flexible flat cable the foam insulator is relatively large having a thickness of 150 μm to 250 μm and for the metallic layer having an attached conductivity adhesive layer, a metallic layer laminated with aluminum foil and base film is used.

It is to be noted that many high frequency cables taking into consideration the effect of the shield and electrical characteristics, mostly extremely fine coaxial cables and the like, are being sold, but for a high price and furthermore use specialized connecters which, accompanied by the specialized terminal furnishment necessary for connecting the connecters, require a large amount of wiring production costs and have poor effectiveness making them not generally applicable when compared to the FPC connecters. Furthermore, the high frequency waves are generally classified by MHz bandwidth and GHz bandwidths, but the high frequency cables being sold have specifications that are usable with GHz bandwidths. Because of this regardless of the fact that only the MHz bandwidth is to be used, it is necessary in actuality to use an expensive cable with a GHz bandwidth, imposing a large burden of cost. Also, the technology described above in Patent Document 1, having the objective of regulating the characteristic impedance in general high frequency circuits to an appropriate level of 50 Ohms, is completely inappropriate for machines that require other types of characteristic impedance and differential impedance.

Accordingly, with cables following the FFC, it is anticipated that it will be possible to show high effects from the shield without incurring losses of the electrical characteristics and the desired differential impedance will be able to be realized.

SUMMARY

The present invention, in consideration of the circumstances, is presented with the objective of being a flexible flat cable, which while maintaining the effect of the shield does not lose the electrical characteristics, also appropriate for use with existing connecters, and making matching electrical characteristics by means of existing processes. The invented flexible flat cable, furthermore, is capable of being established with any number of wires, any length of cable, and any alignment of wiring.

The flexible flat cable of this invention has the feature of being devised with attention given to the dielectric constant and thickness of the insular material as well as the effects of the shield layer material upon the impedance.

In other words, the flexible flat cable of the present invention that fulfills the aforementioned objective is equipped with an arrangement of multiple conductors arranged to include a signal line and at least one ground line, first and second insular materials sandwiching the multiple conductors from both ends, shield material attached to a side of the first insular material opposite to the multiple conductors, the shield material being conductive via a conductive adhesive agent with the ground line out of the multiple conductors, and a reinforcement board attached to the side of the second insular material opposite the multiple conductors. In the flexible flat cable, the multiple conductors, each having a conducting width from 0.3±0.03 mm, are arranged in a parallel manner with a pitch of 0.5±0.05 mm, the first insular material is porous polyethylene trephthalate made of, starting from the side affixed to the shield material, a polyethylene trephthalate film, a substantially 34 μm thick porous layer, and an insular adhesive layer, and the shield material is made in a laminating manner, starting from the side affixed to the first insular material, of a conductive adhesive layer made of the conductive adhesive agent, a shield layer made of a polymer-based conductive layer less than 20 μm thick that is a prescribed resin formed including air with uniformly dispersed conductive particles, and base film.

The flexible flat cable of this type of invention uses porous polyethylene trephthalate having a porous layer with a thickness of substantially 34 μm as the first insular material. Therefore, in the flexible flat cable of the present invention, by the combination of the dielectric constant of the insular material and the dielectric constant of the air containing the porous layer, the dielectric constant becomes comparatively lower than that of insular material not containing a porous layer. Accordingly, in the flexible flat cable of the present invention, regulation of the electrostatic capacity determined by differential impedance is possible due to the decrease in the dielectric constant.

In addition, in the flexible flat cable of the present invention, the differential impedance and the electrostatic capacity created by the space between the conductor and the shield layer can be regulated by using a polymer-based conductive layer containing air with a thickness no greater than 20 μm and containing uniformly dispersed conductive particles in a prescribed resin, as the shield material.

Here, it is desirable for the shield to have a thickness of 10 μm, so that the differential impedance becomes 100 Ohms.

In addition, it is desirable for the shield material to have a surface resistivity equal to or below 10 Ohms/square and it is further desirable that the porous layer have a porous ratio of approximately 22%.

Further, conductive carbon can be used as the conductive particle contained in the shield layer and butylene rubber, polyester, urethane, or the like can be used as the resin forming the shield layer.

Yet further, starting from the side attached to the reinforcement board, the laminated base film and insular adhesive layer can be used as the second insular material.

In addition, soft copper that has received surface processing by a prescribed metal plating of tin and such can be used for each of the conductors.

Also, starting from the side attached to the second insular material, the base film and insular adhesive layer that have been laminated can be used as the reinforcement board.

The present invention as described above makes it possible to regulate the electrostatic capacity through the use of shield material having low dielectric constant insular material and polymer-based conductive layer, and as a result is able to avoid a decrease in differential impedance and achieve the desired value of 100 Ohms. Accordingly, the present invention is able to maintain the shield effect while avoiding the loss of electrical characteristics. Also, the present invention can be manufactured inexpensively due to its ability to match with electrical characteristics by existing processes and its compatibility with existing connecters, and furthermore can be established with any number of wires, cable length, and wiring arrangement.

Additional features and advantages of the present invention are described in, and will be apparent from, the following Detailed Description and the FIGS.

BRIEF DESCRIPTION OF THE FIGURES

FIG. 2(*b*) is a planar view explaining the FFC structure until now shown in FIG. 2(*a*).

FIG. 11(*b*) is a diagram showing the eye pattern measurement results using the experimentally produced FFC and the eye pattern measurement results from an FFC using shield material made from evaporated aluminum shield material.

FIG. 11(*c*) is a diagram showing the eye pattern measurement results using the experimentally produced FFC and the eye pattern measurement results from the FFC shown in FIG. 7 using shield material made from polymer-based shield material.

FIG. 13(*b*) is a diagram showing the eye pattern measurement results of the experimentally produced FFC and the eye pattern results of the comparative example.

DETAILED DESCRIPTION

Hereinafter, specific embodiments to which the present invention is applied are described in detail with reference to the illustrations.

This embodiment is a flexible flat cable (Flexible Flat Cable; hereinafter referred to as FFC) used as a connecting cable in various internal systems disposed within various electrical products. This FFC is especially suitable for high frequency and, as a result of the committed research of the inventors and the selection of structure and materials, has attained the ability to maintain the shield effect without losing the electrical characteristics.

First, in order to clarify the present invention, the FFC achieved through the independent research of the inventors leading to the present invention will be described.

The inventors, along with using porous polyethylene trephthalate (Hereinafter referred to as PET) as the insular material, composed an FFC using evaporated silver shield material with an attached conductive adhesive agent for the shield material and tested the matching of the electrical characteristics.

Figure 1:
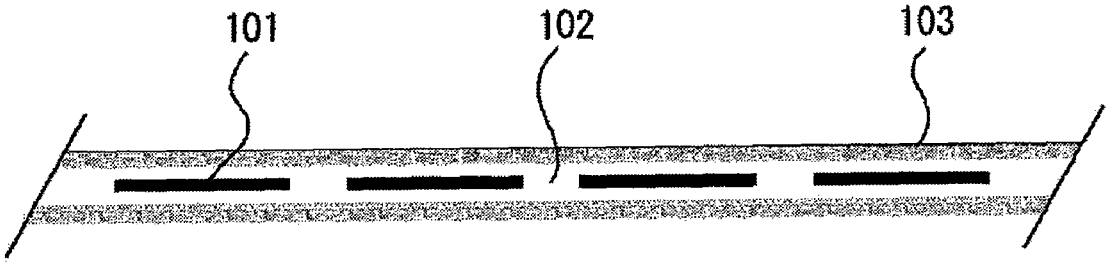
FIG. 1 is a cross-sectional view explaining the FFC structure until now.
Figure 2A:
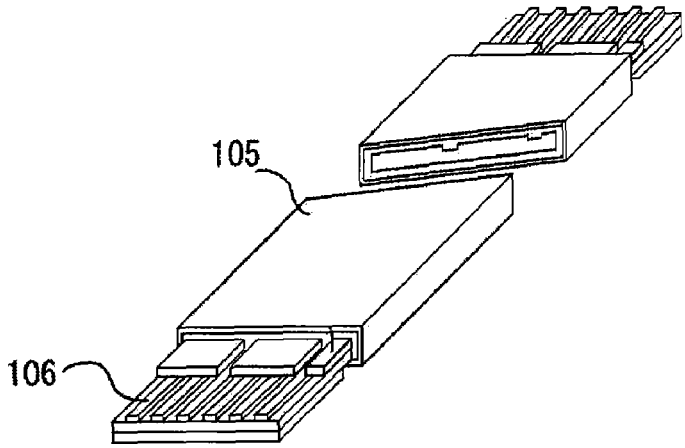
FIG. 2(*a*) is a perspective view explaining the FFC structure until now having a shield layer formed around the circumference of the product to seal the source of noise generation with a metallic film.
Figure 2B:
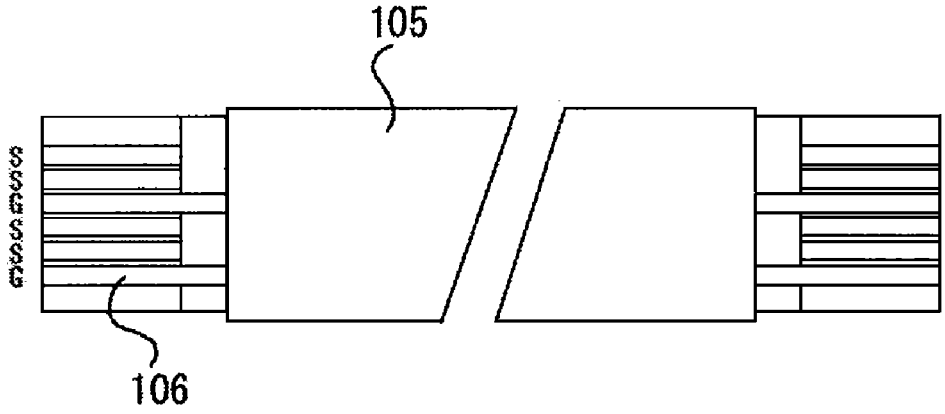
Figure 3:
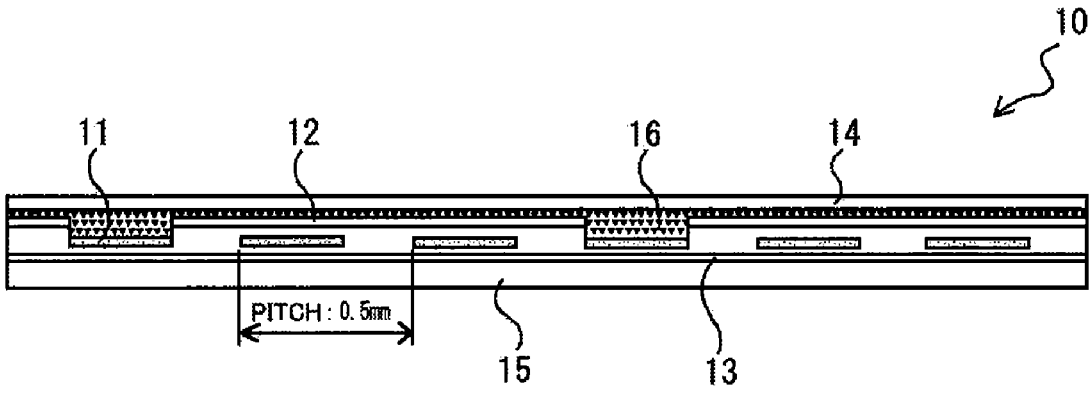
FIG. 3 is a cross-sectional view explaining the structure of the experimentally produced FFC using evaporated silver shield material as a shield material.

This gives attention to the low drift due to temperature change and the low amount of change even by wide bandwidth of the conductive resistance of the conductive adhesive agent used as the shield material. Actually, the inventors, using specifications shown in the following Table 1 for conductors, insular materials and shield materials, experimentally produced an FFC 10 as shown in FIG. 3.

In other words, this FFC 10 is constructed in a manner such that multiple conductors 11, arranged in a parallel manner with a pitch of 0.5 (±0.05)mm, are laminated after being sandwiched between the first insular material 12 having an attached adhesive agent and the second insular material 13, and the shield material 14 is adhered to the side of the first insular material 12 opposite the conductors 11 by whereas the prescribed reinforcement board 15 is adhered to the side of the second insular material 13 opposite the conductors 11. The shield material 14 and the conductors that become the ground line out of the multiple conductors are made conductive by connecting with each other via the conductive adhesive agent 16.

Figure 4:
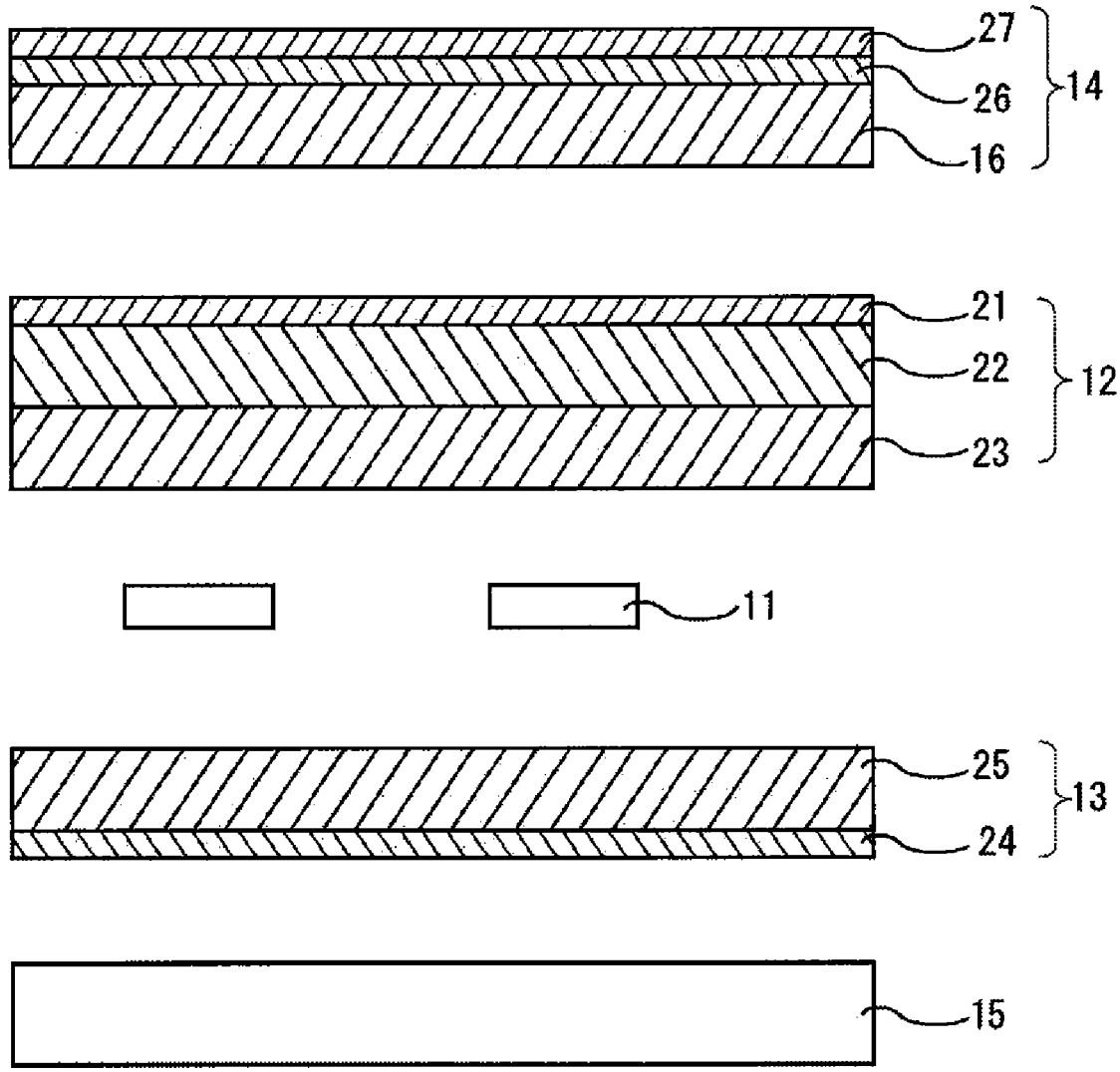
FIG. 4 is an exploded cross-sectional view explaining the detailed structure of the FFC shown in FIG. 3.
Figure 5:
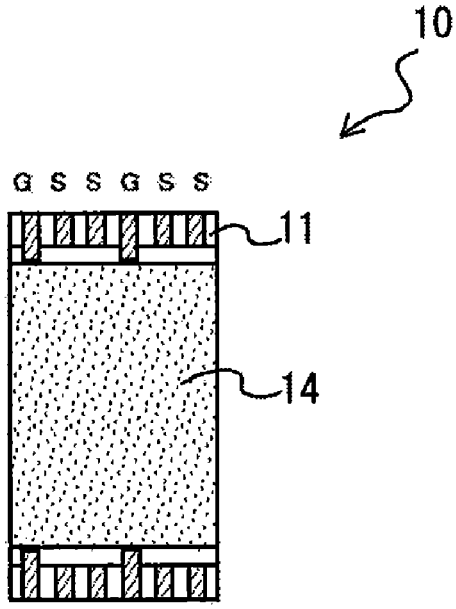
FIG. 5 is a planar view explaining the structure of the FFC shown in FIG. 3.

More specifically, the conductors 11 used are soft copper with a width of 0.3 (±0.03)mm and a thickness of 0.035 mm that has received surface processing through tin plating. Also, the first insular material 12 as a low dielectric material used is a porous PET having a total width of 68 μm and made in a laminating manner, starting form the side attached to the shield material 14, of a PET film 21 made of 4 μm thick base film, a 34 μm thick porous layer 22, and a 30 μm thick insular adhesive layer 23 as shown in FIG. 4. Further, as shown in the same diagram, the second insular material 13 used is, in a laminating manner starting form the side attached to the reinforcement board 15, PET film 24 made of 12 μm thick base film and a 25 μm thick insular adhesive layer 25. Furthermore, as shown in the same diagram, the shield material 14 used is evaporated silver shield material made in a laminating manner, starting from the side attached to the first insular material 12, of a 20 cm thick conductive adhesive layer 16, a 0.1 μm thick evaporation coating layer 26, and a PET film 27 made of 9 μm thick base film having been laminated with a combined thickness of 29.1 μm. This FFC 10, as shown in FIG. 5 with an arrangement of a ground line (G), a signal line (S), a signal line (S), a ground line (G), a signal line (S), a signal line (S), etc. and including a signal line and at least one ground line, has a wiring arrangement suitable for differential transmissions.

The inventors, using this type of the FFC, measured the characteristic impedance and differential impedance through the so-called TDR (Time Domain Reflectometry) method. Through this measurement, with three prescribed points of the transmission path set as the measurement points, the average value of the measurement results of these measurement points is calculated. The measurement results are shown in the following Table 2. It is to be noted that, the TDR method is able to measure electromagnetic waves caused by high frequency band range with a range of 1 MHz to 30 GHz and display the wave shape along a time axis.

TABLE 1

| | Material | Surface Processing | Size (mm) | PET Thickness (μm) | Insular Layer/Shield Layer Thickness (μm) | Adhesive Layer Thickness (μm) | Total Thickness (μm) |
|---|---|---|---|---|---|---|---|
| Conductors | Soft Copper | Tin Plating | Width: 0.3<br>Thickness: 0.035 | — | — | — | — |
| Insular Material | Porous PET | — | — | 4 | 34 | 30 | 68 |
| Shield Material | Evaporated Silver PET | — | — | 9 | 0.1 | 20 | 29.1 |

TABLE 2

MEASUREMENT RESULTS

| Materials Used | | Characteristic | Differential | Electrostatic Capacity |
|---|---|---|---|---|
| Insular Material | Shield Material | impedance (Ohms) | Impedance (Ohms) | (at 1 MHz) (pF/m) |
| Porous PET | Evaporated Silver PET | 50.0 | 81.3 | 192 |

In the manner described above, the FFC 10 is able to attain matching of the electrical characteristics and make the characteristic impedance 50 Ohms by using the porous PET as the first insular material 12 and evaporated silver shield material as the shield material 14. This type of the FFC 10 can be inexpensively manufactured with existing equipment due to its ability to be manufactured through existing manufacturing processes.

Furthermore, the inventors further modified this FFC 10 and attempted to gain much larger characteristic impedance and set the differential impedance near 100 Ohms. Specifically, the inventors used the porous PET for the insular material in the same way as the FFC 10 but used a polymer-based-based material for the shield material.

Figure 6:
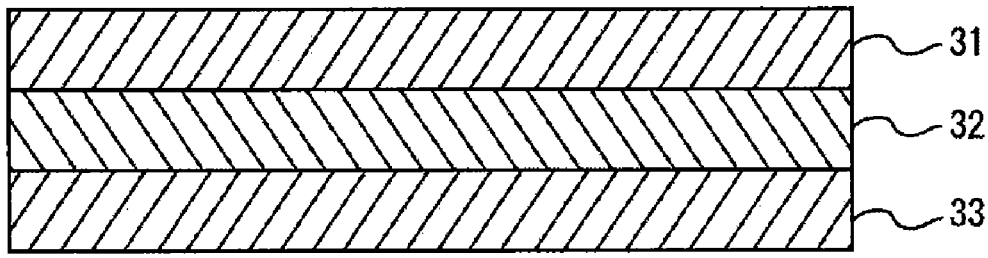
FIG. 6 is a cross-sectional view explaining the structure of the polymer-based shield material.

The polymer-based shield material, as shown in FIG. 6, has a three-layered structure comprising a PET film 31 serving as the base film, a polymer-based-based conductive layer 32 as the shield layer, and a conductive adhesive layer 33. The polymer-based-based conductive layer 32 is interfused with uniformly dispersed conductive particles of conductive carbon and the like in the prescribed resin of butylene rubber and polyester, urethane and the like. Here, a shield layer formed in a membranous shape is generally used as the shield material but the polymer-based-based shield material does not have a shield layer formed in a membranous shape but rather has a polymer-based conductive layer 32 formed in a manner including air by which, from the viewpoint of electrical characteristics, attains characteristics equivalent to a metallic mesh membrane. That is to say, the polymer-based shield material does not have a uniform membranous shield layer and due to its existence with air has anisotropic properties and allows a wider distance between the conductors than shield material made from an evaporated metallic body, and is different from simple metallic shielding material in that it is advantageous in the regulation of electrical characteristics.

Figure 7:
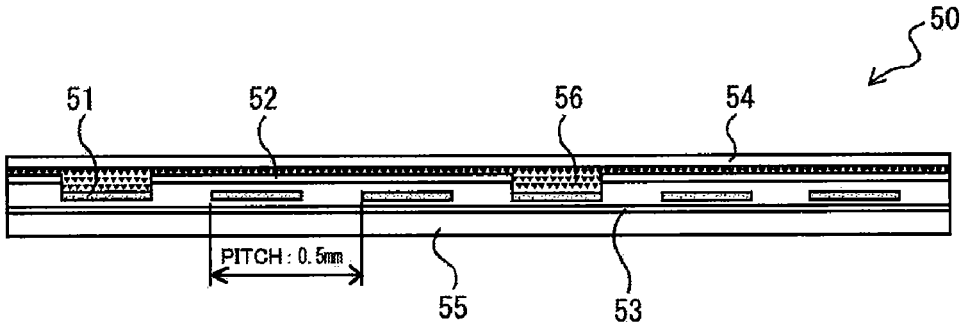
FIG. 7 is a cross-sectional view explaining the structure of the experimentally produced FFC using polymer-based shield material as a shield material.

In the manner described above, the inventors were able to regulate the electrical characteristics by the construction of appropriately dispersed conductive particles and also, through the use of polymer-based shield material able to attain the shield effect, attempted to increase the characteristic impedance. Actually, the inventors experimentally produced an FFC 50 like that shown in FIG. 7 using the specifications shown in Table 3 for the conductors, the insular material, and the reinforcement board and using specifications shown in Table 4 for the shield material.

TABLE 3

EXPERIMENTALLY PRODUCED SIMILAR MATERIALS

| | Material | Size (mm) | PET Thickness (μm) | Porous Layer Thickness (μm) | Adhesive Layer Thickness (μm) | Total Thickness (μm) |
|---|---|---|---|---|---|---|
| Conductor | Soft Copper, Tin Plating | Width: 0.3 Thickness: 0.035 | — | — | — | — |
| Insular Material | Porous PET | — | 4 | 34 | 30 | 68 |
| Insular Material (TC) | PET | — | 25 | — | 35 | 60 |
| Reinforcement Board | PET | — | 188 | — | 40 | 228 |

TABLE 4

EXPERIMENTALLY PRODUCED SHIELD MATERIALS (3 varieties)

| | Material | PET Thickness (μm) | Shield Layer Thickness (μm) | Adhesive Layer Thickness (μm) | Total Thickness (μm) |
|---|---|---|---|---|---|
| Shield Materials | Polymer-based Shield Material | 25 | 22 | 35 | 82 |
| | Evaporated Silver PET | 9 | 0.1 | 20 | 29.1 |
| | Evaporated Aluminum PET | 12 | 0.06 | 25 | 37.06 |

In other words, this FFC 50 is constructed in a manner such that multiple conductors 51, arranged in a parallel manner with a pitch of 0.5 (±0.05)mm, are laminated after being sandwiched between a first insular material 52 having an attached adhesive agent and a second insular material 53. The shield material 54 is adhered to the side of the first insular material 52 opposite the conductors 51 whereas the prescribed reinforcement board 55 is adhered to the side of the second insular material 53 opposite the conductors 51. The shield material 54 and the conductor 51 that become the ground line out of the multiple conductors 51 are made conductive via the conductive adhesive agent 56.

Figure 8:
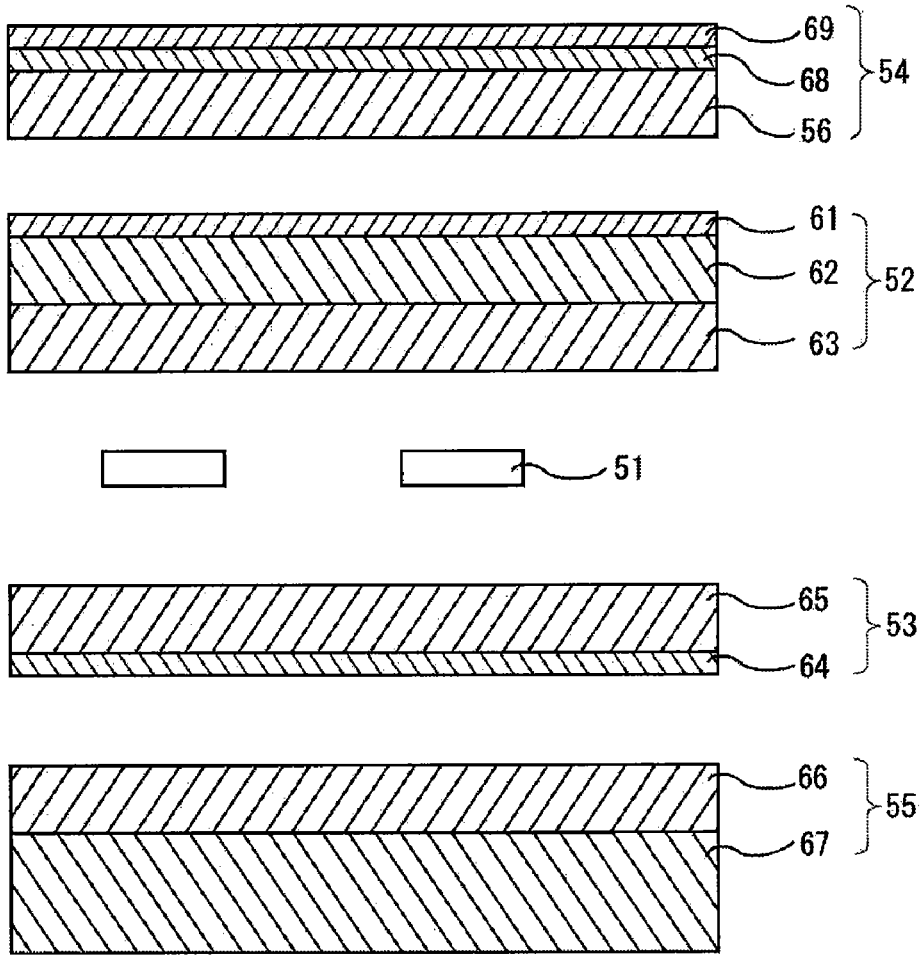
FIG. 8 is an exploded cross-sectional view explaining the detailed structure of the FFC shown in FIG. 7.
Figure 9:
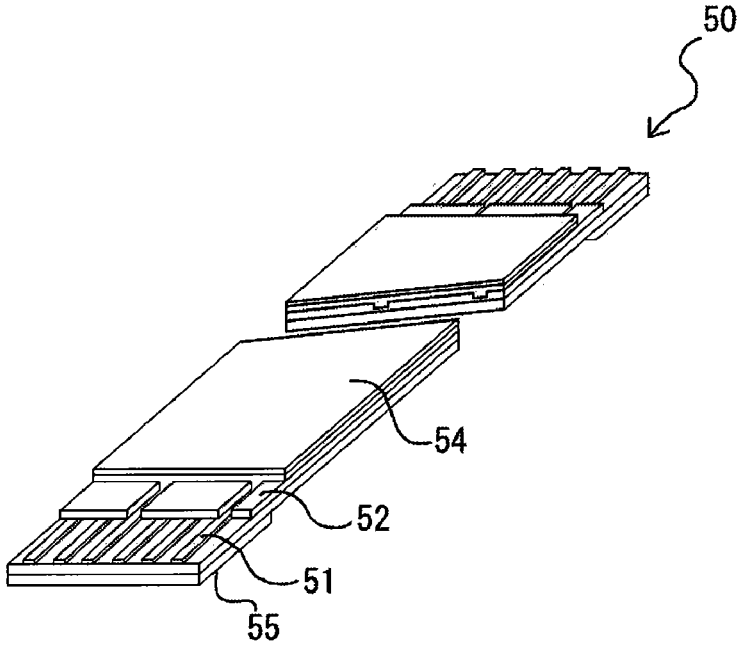
FIG. 9 is a perspective view explaining the structure of the FFC shown in FIG. 7.
Figure 10:
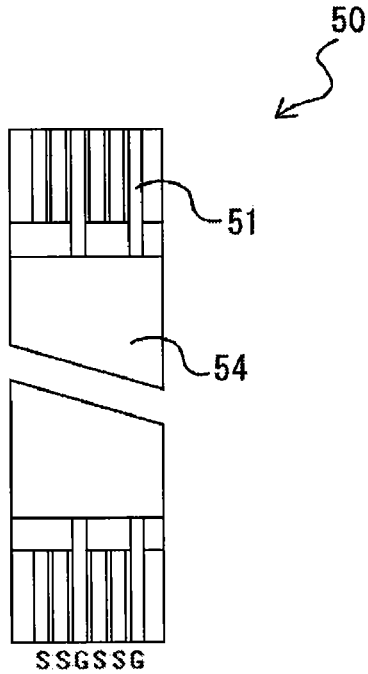
FIG. 10 is a planar view explaining the structure of the FFC shown in FIG. 7.

More specifically, in a manner similar to that of FFC 10, the conductors 51 used are soft copper with a width of 0.3 (±0.03) mm and a thickness of approximately 0.035 mm that has received surface processing through tin plating. Also, the first insular material 52 as a low dielectric material used is a porous PET having a total width of substantially 68 μm and made of, in a laminating manner starting form the side attached to the shield material 54, a PET film 61 made of 4 μm thick base film, a 34 μm thick porous layer 62, and a 30 μm thick insular adhesive layer 63 as shown in FIG. 8. Further, as shown in the same diagram, the second insular material 53 used is, in a laminating manner starting form the side attached to the reinforcement board 55, a PET film 64 made of 35 μm thick base film and a 25 μm thick insular adhesive layer 65. Furthermore, as shown in the same diagram, the reinforcement board 55 used is, in a laminating manner starting from the side attached to the second insular material 53, a 40 μm thick insular adhesive layer 66 and a 188 μm thick PET. In addition, as shown in the same diagram, the shield material 54 used is a polymer-based shield material made, in a laminating manner starting from the side attached to the first insular material 52, of a 35 μm thick conductive adhesive layer 56, a 22 μm thick polymer-based conductive layer 68, and a PET film 69 made of 25 μm thick base film with a combined thickness of 82 μm. This FFC 50, as shown in FIG. 9 and FIG. 10 with an arrangement of a ground line (G), a signal line (S), a signal line (S), a ground line (G), a signal line (S), a signal line (S), etc. and including a signal line and at least one ground line, has a wiring arrangement suitable for differential transmissions.

In addition, for comparative purposes, the inventors experimentally produced an FFC using an evaporated silver shield layer comprising a laminated 20 mm thick conductive adhesive layer and 9 mm thick PET film with 0.1 mm thick evaporated silver for a total thickness of 29.1 mm, an FFC using an evaporated aluminum shield layer comprising a laminated 25 mm thick conductive adhesive layer and 12 mm thick PET film with 0.06 mm thick evaporated aluminum for a total thickness of 37.06 mm, and an FFC with no shield material equipped.

The inventors, using this type of FFC 50 and the experimentally produced FFC for comparative purposes, conducted characteristic impedance, differential impedance, electrostatic capacity, and eye pattern measurements.

The characteristic impedance and differential impedance, with three prescribed points of the transmission path set as the measurement points, were measured by the TDR method using a sampling oscilloscope (Model: HP54750A) and a TDR module (Model: HP54754), both produced by the Hewlett-Packard company, and the average value of these measurement results was determined. Also, the electrostatic capacity was measured, having been swept with a frequency from 1 MHz to 1.8 GHz by an impedance analyzer (Model: 4291B) produced by the Agilent Technologies company, and a measurement value of 1 MHz was determined. Further, the eye pattern was measured using the differential transmission method by a sampling oscilloscope (Model: 86100A) and pulse generator (Model: 81133A), both produced by the Agilent Technologies company, and, along with a measured frequency range of 400 MHz, a wave frequency with a rising edge introduced at 2.5 ns was determined.

Figure 11A:
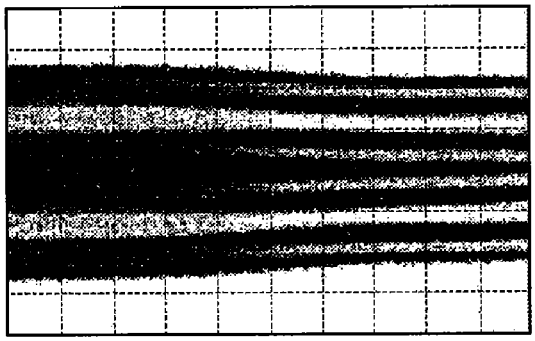
FIG. 11(*a*) is a diagram showing the eye pattern measurement results using the experimentally produced FFC and the eye pattern measurement results from an FFC using shield material made from evaporated silver shield material.
Figure 11B:
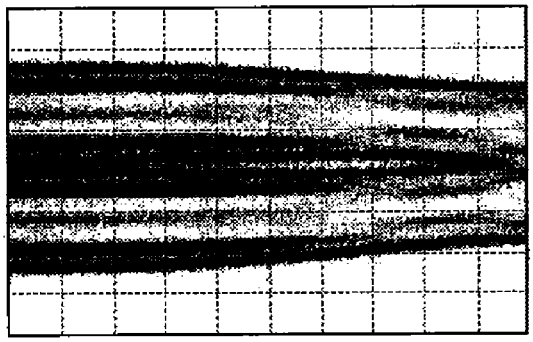
Figure 11C:
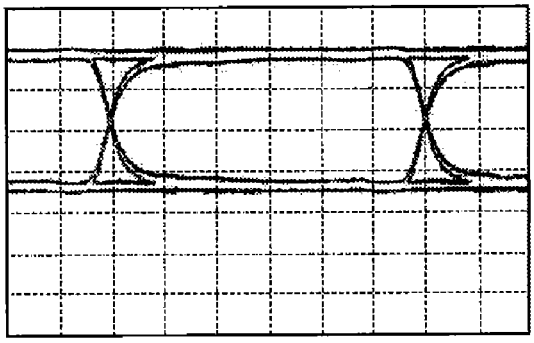

The measurement results of the characteristic impedance, differential impedance, and electrostatic capacity are shown in the following Table 5. Also, the measurement results of the eye pattern are shown in FIG. 11(*a*) and FIG. 11(*c*). In addition, FIG. 11(*a*) shows the eye pattern measurement results of an FFC using evaporated silver shield material as the shield material, FIG. 11(*b*) shows the eye pattern measurement results of an FFC using evaporated aluminum shield material as the shield material, and FIG. 11(*c*) shows the eye pattern measurement results of an FFC 50 using polymer-based shield material as the shield material.

TABLE 5

MEASUREMENT RESULTS

| Experimentally Produced Product-type | Cable Length (mm) | Material Used: Insular Layer | Material Used: Shield Layer | Average Value of Characteristic impedance (Ohms) | Average Value of Differential Impedance (Ohms) | Electrostatic Capacity (at 1 MHz) (p F/m) |
|---|---|---|---|---|---|---|
| Without Shield Material | 200 | Porous PET | Nothing | 93.8 | 141.2 | 48.5 |
| | | | | 92.6 | 140.8 | 50.5 |
| | | | Evaporated Silver | 38.7 | 61.9 | 205.0 |
| | | | | 39.2 | 62.0 | 204.5 |
| | | | | 38.2 | 61.7 | 205.0 |
| | | | | 38.5 | 62.7 | 207.5 |
| With Shield Material | | | Evaporated Aluminum | 44.0 | 64.3 | 200.5 |
| | | | | 44.2 | 65.8 | 203.5 |
| | | | Polymer-based Shield Material | 72.2 | 110.9 | 121.5 |
| | | | | 71.2 | 110.5 | 131.0 |

From these measurement results it is understood that through the FFC using evaporated aluminum and evaporated silver shield material for the shield material, the decrease in impedance originating from the increase in electrostatic capacity is due to the introduction of a metallic membrane. On the other hand, it is understood that through the FFC 50 using polymer-based shield material for the shield material, the decrease of impedance is avoidable due to the electrostatic capacity of approximately 80 pF/m, which is comparatively lower than that of other FFCs.

From the eye pattern measurement results it is understood that through the FFC 50 using polymer-based shield material for the shield material it is possible to attain sufficient compatibility with a 400 MHz signal transmission due to the low jitter and clear eye pattern of the FFC 50 compared to other FFCs. In addition, the inventors measured the eye pattern with a measured frequency range of 2.5 GHz and a wave frequency with a rising edge introduced at 400 ps but in this situation, not shown, through an FFC 50 using polymer-based shield material as the shield material the jitter increased but the eye pattern could be clearly seen and the possibility for compatibility with a signal transmission of 2.5 GHz was confirmed.

Here, in a situation where two conductors transmitting differential signals with a characteristic impedance $Z_0$ of 50 Ohms are arranged with sufficient separation, the differential impedance becomes $2\times Z_0$=100 Ohms but two conductors placed in close proximity lead to electrical merging which is known to lower the differential impedance between the conductors. Accordingly, in a situation where two conductors are arranged in close proximity in an FFC, for such reasons as increasing the wire density, a decrease in impedance occurs.

From this viewpoint, the various types of experimentally produced FFCs can be thought of as having electrical merging between two adjacent conductors at the time of differential signal transmission due to the close proximity of the space between the conductors having a pitch of 0.5 (±0.05)mm. As described above, the differential impedance should be, in theory, double the characteristic impedance but, as shown in Table 5, is stuck at a value of approximately 1.5 times to 1.6 times. The occurrence of electrical loss caused by the electrical merging occurring between the adjacent conductors can be thought of as the reason for this.

However, the FFC 50 using polymer-based shield material as the shield material results in a characteristic impedance 30 Ohms greater and a differential impedance 45 Ohms greater than other FFCs. This type of the FFC 50 is constructed using, aside from the shield material, the same materials as other FFCs making it effective both for avoiding a decrease in impedance and as a counter-measure to unnecessary radiation (Electromagnetic Interference; EMI).

In addition, from the viewpoint of electrostatic capacity, because of the increase in electrostatic capacity caused by the formation of a plate-like shield layer it is possible to decrease the electrostatic capacity with a mesh-like shield layer but in this situation, from the perspective of mobility, there is concern that the stress placed on the mesh layer may cause detachment and short-circuiting between the conductors. On the other hand, the FFC 50, through the use of polymer-based shield material as the shield material, is able to regulate the electrical characteristics while avoiding these inconveniences, provide an effective counter-measure for unnecessary radiation, and maintain favorable mobility.

Figure 12:
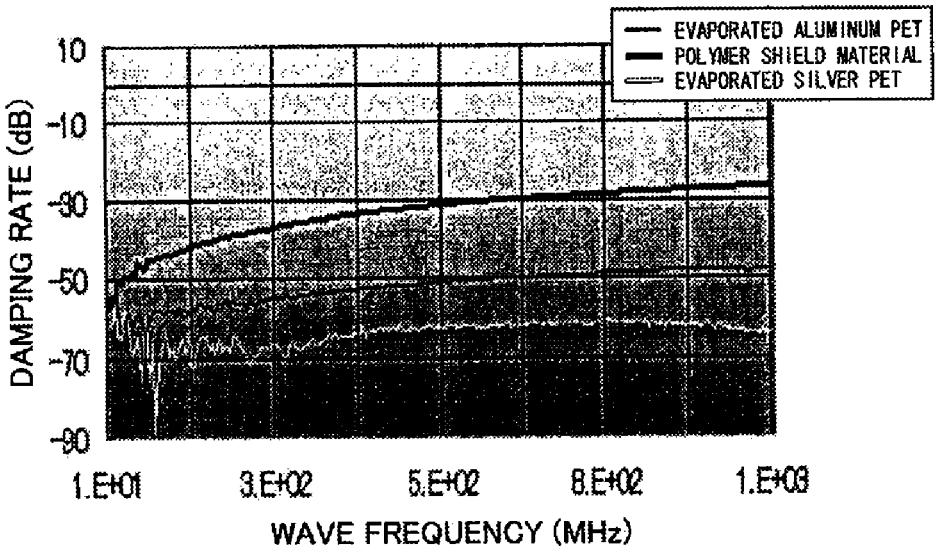
FIG. 12 is a diagram showing the attenuating rate measurement results caused by the electric field of the simple shield material used in the experimentally produced FFC.

The measurement results of the attenuating rate by the electrical field from the simple shield material used in an experimentally produced FFC are shown in FIG. 12. In addition, in the same diagram the wave frequency (from 1 MHz to 1 GHz) is shown on the horizontal axis and the attenuating rate is shown on the vertical axis.

From these measurement results it is understood that the attenuating rate by the electrical field of polymer-based shield material is smaller than that of other membranous shield materials made from evaporated aluminum shield material or evaporated silver shield material. This is due to interfusion of uniformly dispersed conductive particles of conductive carbon and the like in the resin of butylene rubber and the like by the polymer-based conductive shield and this data is able to confirm that the shield layer possesses properties equivalent to a mesh-like shield layer. In addition, it is known that for holding the shield effect favorable results are gained from a multi-layered shield but damaging of the electrical characteristics may occur due to these multiple layers. In the FFC it is ideal to have both a shield effect and electrical traits but, in situations where the wiring is closely packed like a situation where the wiring pitch of the conductors is narrow or the thickness of the cable is thin, the conflicting relationship of the shield effect and electrical traits makes the combination of the two difficult and narrows the maintainable and combinable range of favorable traits from both a physical and electrical viewpoint. The polymer-based shield material, even under the strict specifications mentioned above, possesses properties equivalent to a mesh-like membrane and is therefore extremely effective.

Meanwhile, the inventors further improved this type of FFC 50 and attained an FFC able to achieve differential impedance of 100 Ohms as shown in the embodiment of the present invention and achieved precise impedance regulation through the identification of materials and adjustment of width of the polymer-based conductive layer.

Specifically, the inventors used the specifications shown in the following Table 6 for the conductors and reinforcement board along with the specifications shown in the following Table 7 for the insular material. Also, the inventors experimentally produced, as shown in the following Table 8, FFCs using each of two types of polymer-based shield material having polymer-based conductive layers of dispersed carbon shield layers with electrical particles and having thicknesses of 10 μm and 20 μm, evaporated silver shield material possessing a 0.1 μm thick evaporated silver layer, and copper foil shield material possessing a 9 μm thick copper foil layer, for the shield material. In addition, for the shield material and insular material, the combinations shown in the following Table 9 were used for the first and second embodiments and the combinations shown in the following Table 10 were used for the first through eighth comparative examples. Here, the porous layer made by porous PET has a porous ratio of 22% and the polymer-based shield material has a surface resistivity below 10 Ohms/square.

TABLE 6

EXPERIMENTALLY PRODUCED SIMILAR MATERIALS

| | Material | Size (mm) | PET Thickness (μm) | Porous Layer Thickness (μm) | Adhesive Layer Thickness (μm) | Total Thickness (μm) |
|---|---|---|---|---|---|---|
| Conductor | Soft Copper, Tin Plating | Width: 0.3<br>Thickness: 0.035 | — | — | — | — |
| Reinforcement Board | PET | — | 188 | — | 35 | 223 |

TABLE 7

EXPERIMENTALLY PRODUCED INSULAR MATERIALS

| | PET Thickness (μm) | Porous Layer Thickness (μm) | Adhesive Layer Thickness (μm) | Total Thickness (μm) |
|---|---|---|---|---|
| Insular Material (Porous PET) | 4 | 34 | 30 | 68 |

TABLE 7-continued

EXPERIMENTALLY PRODUCED INSULAR MATERIALS

| | PET Thickness (μm) | Porous Layer Thickness (μm) | Adhesive Layer Thickness (μm) | Total Thickness (μm) |
|---|---|---|---|---|
| Insular Material (TC) | 12 | — | 25 | 37 |
| Insular Material (TC) | 23 | — | 42 | 65 |

TABLE 8

EXPERIMENTALLY PRODUCED SHIELD MATERIALS

| | PET Thickness (μm) | Shield Layer Thickness (μm) | Adhesive Layer Thickness (μm) | Total Thickness (μm) |
|---|---|---|---|---|
| Polymer-based | 25 | 10 | 25 | 60 |
| Polymer-based | 25 | 20 | 25 | 70 |
| Evaporated Silver | 9 | 0.1 | 20 | 29.1 |
| Copper Foil | 12 | 9 | 20 | 41 |

TABLE 9

EMBODIMENTS

| | | first Embodiment | second Embodiment |
|---|---|---|---|
| Shield Material | Polymer-based: 10 μm Thick | ○ | |
| | Polymer-based: 20 μm Thick | | ○ |
| | Evaporated Silver | | |
| | Copper Foil | | |
| Insular Material | Porous PET(03T15) | ○ | ○ |
| | PET(TC7907N) | | |
| | PET(F2100) | | |
| Differential Impedance (Ohms) | | 98 | 96 |

Figure 13A:
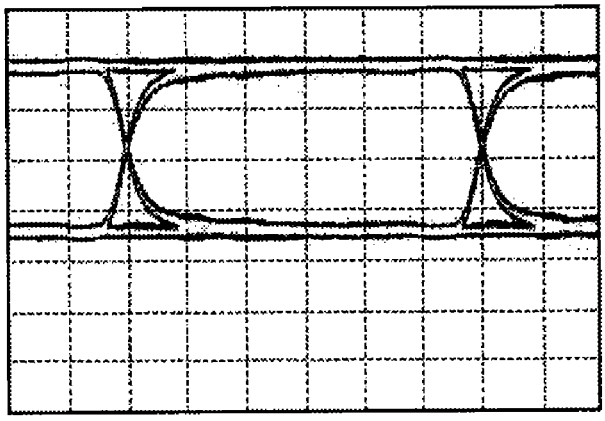
FIG. 13(*a*) is a diagram showing the eye pattern measurement results of the experimentally produced FFC and the eye pattern results of the first embodiment.
Figure 13B:
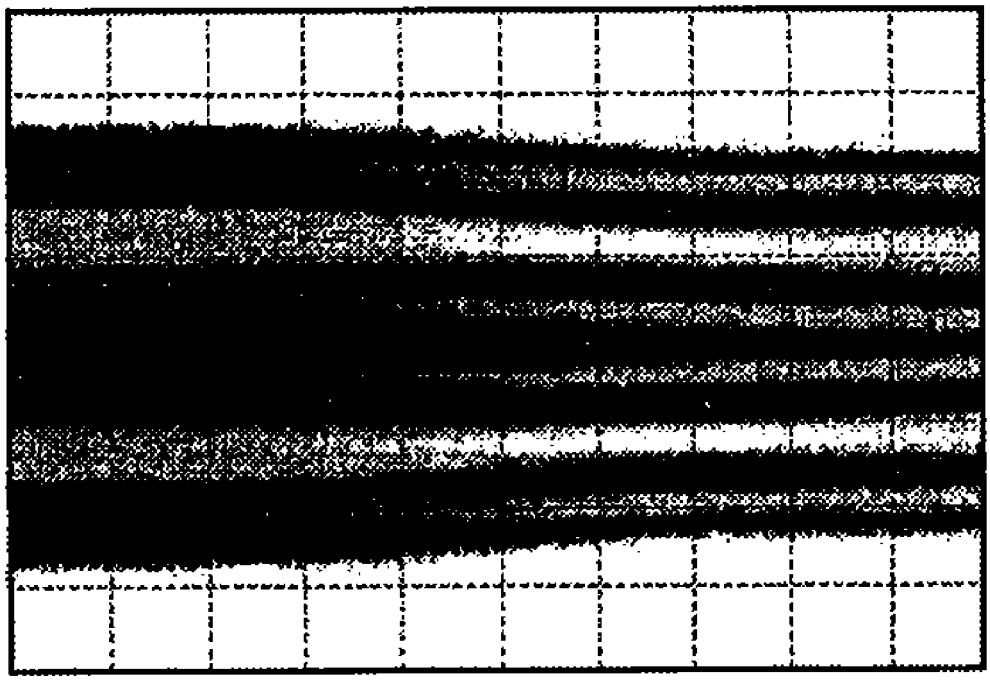

GS500/SG500) produced by the Cascade Microtech company and the average value of these measurement results was calculated. Also, as described above, the eye pattern was measured using the differential transmission method by a sampling oscilloscope (Model: 86100A) and pulse generator (Model: 81133A), both produced by the Agilent Technologies company, and, along with a measured frequency range of 400 MHz, a wave frequency with a rising edge introduced at 2.5 ns was determined. The differential impedance measurement results of all the embodiments and comparative examples are shown above in Table 9 and Table 10. Furthermore, the eye pattern measurement results of the embodiments and comparative examples are shown in FIG. 13(*a*) and FIG. 13(*b*).

From these measurement results it is understood that, through the use of porous PET for the insular material along with the first and second embodiments using polymer-based shield material with dispersed carbon for the shield material, the differential impedance becomes roughly 100 Ohms. In particular, the 10 mm thick polymer-based conductive layer of the first embodiment attains more favorable results when compared to the second embodiment. On the other hand, porous PET was used as the insular material in the first and second comparative examples but it is understood that using evaporated silver shield material and copper foil shield material for the shield material causes a decrease in the differential impedance.

Also, from the eye pattern measurement results it is understood that in the first embodiment jitter is low and the eye pattern is clear making it sufficiently appropriate for high speed transmissions. On the other hand, in the first comparative example it is understood that the eye pattern is unclear and signal reflection occurs in the transmission path due to the lack of impedance matching. In addition, in the second through eighth comparative examples, not shown diagrammatically, the impedance mismatch results in the eye pattern being unclear.

The impedance is affected by the thickness and permittivity of the insular material and the material of the shield layer. The porous PET, through the combination of the permittivity of the insular material and the permittivity of the porous layer containing air, has lower permittivity compared to insular layers conventionally used in FFCs not containing air. Accordingly, in an FFC using porous PET as the insular material, it is possible to regulate the electrostatic capacity that determines the differential impedance and set the differential impedance to 100 Ohms due to the decrease in permittivity.

TABLE 10

COMPARATIVE EXAMPLES

| | | Comparative Example 1 | Comparative Example 2 | Comparative Example 3 | Comparative Example 4 | Comparative Example 5 | Comparative Example 6 | Comparative Example 7 | Comparative Example 8 |
|---|---|---|---|---|---|---|---|---|---|
| Shield Material | Polymer-based: 10 μm Thick | | | ○ | | | ○ | | |
| | Polymer-based: 20 μm Thick | | | | | | | | |
| | Evaporated Silver | ○ | | | ○ | | | ○ | |
| | Copper Foil | | ○ | | | ○ | | | ○ |
| Insular Material | Porous PET(03T15) | ○ | ○ | | | | | | |
| | PET(TC7907N) | | | ○ | ○ | ○ | | | |
| | PET(F2100) | | | | | | ○ | ○ | ○ |
| Differential Impedance (Ohms) | | 68 | 54 | 63 | 56 | 42 | 78 | 61 | 50 |

The inventors measured the differential impedance and eye pattern using these types of FFCs.

The differential impedance, as described above, with three prescribed points of the transmission path set as the measurement points, was measured by the TDR method using a sampling oscilloscope (Model: HP54750A) and a TDR module (Model: HP54754), both produced by the Hewlett-Packard company, and a measurement probe (Model: ACP40 series Also, the material of the shield material laminated above the insular material is an important factor for regulating the electrostatic capacity. In a situation where, for example, the regulation of differential impedance is based on a fixed prescribed material for the shield material in the FFC, it is necessary to take such physical measures as changing the distance between the shield and conductors by changing the cross-sectional area of the conductors, changing the pitch between conductors, and changing the thickness of the insular material. However, in a situation where the cross-sectional area of the conductors and the pitch between conductors has been changed in the FFC, compatibility with conventional FFCs is lost and it becomes necessary to use specialized connection shapes for terminal connectors. Also, in situations where the thickness of the insulating layer has been increased, the cable itself is changed causing problems at the time of implementation. Through the use of the FFC using polymer-based shield material of uniformly dispersed conductive carbon in a resin as the shield material, compared to membranous or mesh-like shield materials, it is possible to regulate and lower the electrostatic capacity occurring between the conductors and the shield layer while preserving favorable mobility and compatibility with existing connectors, which results in the ability to set the differential impedance to 100 Ohms.

In manner described above, an impedance of 100 Ohms can be realized only in an FFC cable with an insular layer of suitable thickness and permittivity important for regulating the impedance, a suitable combination of materials for the shield material, porous PET that is a 34 μm thick porous layer for the insular material, and polymer-based shield material serving as a shield layer made of dispersed conductive carbon for the conductive particles with a thickness below 20 μm, desirably 10 μm, for the shield material.

In addition, due to the structure of the insular material and shield material in the FFC it is unnecessary to have special surface treatment in order to connect to the terminal connecter. Further, the FFC can be manufactured inexpensively and without incurring initial cost due to its ability to be used by existing manufacturing processes and be combined with electrical characteristics by existing manufacturing processes. Furthermore, it is possible for the FFC to have the number of wires, cable length, and wire arrangement containing a conductive ground line with a shield layer set up in any manner.

This type of FFC is ideally suitable for all types of electrical equipment products that require high speed transmission of a signal, for example liquid crystal monitor systems requiring the transmission of high-definition images and, while maintaining the shield effect, is able to avoid damaging the electrical characteristics and, from the perspective of its superior physical characteristics, enables the miniaturization of the electrical equipment products.

In addition, the present invention, not limited by the embodiments described above, can be arbitrarily modified without departing from the scope of this invention.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

What is claimed is:

1. A flexible flat cable comprising:

multiple conductors arranged to include a signal line and at least one ground line;

first and second insular materials sandwiching the multiple conductors from both ends;

shield material attached to a side of the first insular material opposite to the multiple conductors, the shield material being conductive via a conductive adhesive agent with the ground line out of the multiple conductors; and a reinforcement board attached to the side of the second insular material opposite the multiple conductors, wherein the multiple conductors, each having a conducting width from about 0.3±0.03mm, arranged in a parallel manner with a pitch of about 0.5±0.05mm, wherein the first insular material is porous polyethylene trephthalate made of, starting from the side affixed to the shield material, a polyethylene trephthalate film, a porous layer having a thickness of about 34 μm, and an insular adhesive layer, and wherein the shield material is made in a laminating manner, starting from the side affixed to the first insular material, of a conductive adhesive layer made of the conductive adhesive agent, a shield layer made of a polymer-based conductive layer less than about 20μm thick that is a prescribed resin formed including air with uniformly dispersed conductive particles, and base film.

2. The flexible flat cable according to claim 1, wherein the shield layer has a thickness of about 10μm.

3. The flexible flat cable according to claim 1, wherein the shield material has a surface resistivity of 10 Ohms/per square or less.

4. The flexible flat cable according to claim 3, wherein the conductive particles forming the shield layer are conductive carbon.

5. The flexible flat cable according to claim 1, wherein the porous layer has a porous ratio of about 22%.

6. The flexible flat cable according to claim 1, wherein the resin forming the shield layer is butylene rubber, polyester, or urethane.

7. The flexible flat cable according to claim 1, wherein the second insular material is made of, in a laminating manner, starting from the side affixed to the reinforcement board, a base film and an insular adhesive layer.

8. The flexible flat cable according to claim 1, wherein the respective multiple conductors are made of soft copper and receive surface processing by a prescribed metallic plating.

9. The flexible flat cable according to claim 1, wherein the reinforcement board is made in a laminating manner starting from the side affixed to the second insular material, an insular adhesive layer and base film.

* * * * *